US010196592B2

(12) United States Patent
Pham et al.

(10) Patent No.: US 10,196,592 B2
(45) **Date of Patent: *Feb. 5, 2019**

(54) ENHANCED CATALYST STABILITY FOR ALKALINE DETERGENT FORMULATIONS

(71) Applicant: Ecolab USA Inc., Saint Paul, MA (US)

(72) Inventors: Joanna A. Pham, Blaine, MN (US); Jonathan P. Fast, St. Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 29 days.

This patent is subject to a terminal disclaimer.

(21) Appl. No.: 14/303,706

(22) Filed: Jun. 13, 2014

(65) Prior Publication Data

US 2015/0361385 A1 Dec. 17, 2015

(51) Int. Cl.

| | |
|---|---|
| ***C11D 3/10*** | (2006.01) |
| ***C11D 3/39*** | (2006.01) |
| ***C11D 3/395*** | (2006.01) |
| ***C11D 7/12*** | (2006.01) |
| ***C11D 7/38*** | (2006.01) |
| ***C11D 17/00*** | (2006.01) |
| ***C11D 7/26*** | (2006.01) |
| ***D21H 17/27*** | (2006.01) |
| ***D21H 17/36*** | (2006.01) |
| ***D21H 21/32*** | (2006.01) |
| ***C11D 17/06*** | (2006.01) |
| ***C11D 3/22*** | (2006.01) |
| ***C11D 3/04*** | (2006.01) |
| ***C11D 3/08*** | (2006.01) |
| ***C11D 7/06*** | (2006.01) |
| ***C11D 7/14*** | (2006.01) |
| ***D21C 9/10*** | (2006.01) |

(52) U.S. Cl.

CPC ..... *C11D 17/0039* (2013.01); *C11D 3/044* (2013.01); *C11D 3/08* (2013.01); *C11D 3/10* (2013.01); *C11D 3/22* (2013.01); *C11D 3/225* (2013.01); *C11D 3/392* (2013.01); *C11D 3/3917* (2013.01); *C11D 3/3932* (2013.01); *C11D 3/3935* (2013.01); *C11D 3/3942* (2013.01); *C11D 7/06* (2013.01); *C11D 7/12* (2013.01); *C11D 7/14* (2013.01); *C11D 7/268* (2013.01); *C11D 17/0047* (2013.01); *C11D 17/06* (2013.01); *D21C 9/1036* (2013.01); *D21H 17/27* (2013.01); *D21H 17/36* (2013.01); *D21H 21/32* (2013.01)

(58) Field of Classification Search

CPC .. C11D 1/00; C11D 3/044; C11D 3/08; C11D 3/10; C11D 3/3917; C11D 3/392; C11D 3/3942; C11D 3/22; C11D 17/0039; C11D 17/06; C11D 17/0047

USPC ..... 510/302, 311, 349, 376, 441, 445, 446, 510/475, 505, 506, 509, 511

See application file for complete search history.

(56) References Cited

U.S. PATENT DOCUMENTS

| | | | | |
|---|---|---|---|---|
| 4,430,243 | A | 2/1984 | Bragg | |
| 4,478,733 | A | 10/1984 | Oakes | |
| 4,623,357 | A | 11/1986 | Urban | |
| 4,728,455 | A | 3/1988 | Rerek | |
| 5,194,416 | A | 3/1993 | Jureller et al. | |
| 5,227,084 | A | 7/1993 | Martens et al. | |
| 5,246,612 | A | 9/1993 | Van Dijk et al. | |
| 5,356,554 | A | 10/1994 | Delwel et al. | |
| 5,409,627 | A | 4/1995 | Boskamp et al. | |
| 5,429,769 | A | 7/1995 | Nicholson et al. | |
| 5,480,575 | A | 1/1996 | Altieri et al. | |
| 5,536,441 | A | 7/1996 | Chapple et al. | |
| 5,703,034 | A | 12/1997 | Offshack et al. | |
| 7,070,820 | B2 * | 7/2006 | Simonsen ..... | A21D 8/042 426/549 |
| 8,486,881 | B2 | 7/2013 | Borchers et al. | |
| 9,624,119 | B2 * | 4/2017 | Dotzauer ..... | B01J 31/2295 |
| 2004/0266641 | A1 | 12/2004 | Gentschev et al. | |
| 2012/0070554 | A1 | 3/2012 | Dournel | |
| 2013/0061883 | A1 * | 3/2013 | Miravet Celades ..... | A61K 8/38 134/26 |

FOREIGN PATENT DOCUMENTS

| | | | |
|---|---|---|---|
| CA | 2066871 | | 10/1996 |
| CA | 2822012 | A1 | 6/2012 |
| EP | 0141470 | A2 | 5/1985 |
| EP | 0509787 | B1 | 10/1992 |
| EP | 0510761 | A1 | 10/1992 |
| EP | 0510761 | B1 | 10/1992 |
| EP | 0544440 | A1 | 6/1993 |
| EP | 0544490 | A2 | 6/1993 |
| EP | 0544519 | B1 | 6/1993 |
| EP | 0549271 | A1 | 6/1993 |
| EP | 0549272 | A1 | 6/1993 |

(Continued)

OTHER PUBLICATIONS

"Pegasus Chloride 50" Product Data Sheet, Catexel Limited, 2 pages. Aug. 30, 2012.

EP 2106437 B1—Henkel—English Translation May 2, 2012.

PCT, "International Search Report and Written Opinion", issued in connection to International Application No. PCT/US2015/035350, 13 pages, dated Sep. 11, 2015.

*Primary Examiner* — Gregory R Delcotto

(74) *Attorney, Agent, or Firm* — McKee, Voorhees & Sease, PLC

(57) ABSTRACT

Stabilized catalyst detergent compositions are provided in solid alkaline detergent formulations are disclosed. The compositions are suitable for use with additional detergent and/or bleaching compositions while providing stabilized catalysts within an encapsulated cellulose derivative coating. Methods of use for cleaning are disclosed.

14 Claims, No Drawings

(56) References Cited

FOREIGN PATENT DOCUMENTS

| | | | |
|---|---|---|---|
| EP | 0693550 | A2 | 1/1996 |
| EP | 0458397 | B1 | 3/1997 |
| EP | 0458398 | B1 | 3/1997 |
| EP | 1360268 | B1 | 11/2003 |
| EP | 1499702 | B1 | 1/2005 |
| EP | 2106437 | B1 | 5/2012 |
| WO | 9421777 | A1 | 9/1994 |
| WO | 9506710 | A1 | 3/1995 |
| WO | 9606154 | A1 | 2/1996 |
| WO | 9722680 | A1 | 6/1997 |
| WO | 2003072688 | A1 | 9/2003 |
| WO | 2009040545 | A1 | 4/2009 |
| WO | 2010115582 | A1 | 10/2010 |
| WO | 2010139689 | A1 | 12/2010 |
| WO | 2012085534 | A1 | 6/2012 |

* cited by examiner

ENHANCED CATALYST STABILITY FOR ALKALINE DETERGENT FORMULATIONS

CROSS-REFERENCE TO RELATED APPLICATIONS

This application is related to U.S. patent application Ser. No. 14/303,700, now U.S. Pat. No. 9,624,119 filed simultaneously herewith and entitled Enhanced Catalyst Stability in Activated Peroxygen and/or Alkaline Detergent Formulations. The entire contents of this patent application are hereby expressly incorporated herein by reference including, without limitation, the specification, claims, and abstract, as well as any FIGURES, tables, or drawings thereof.

FIELD OF THE INVENTION

The invention relates to stabilized compositions employing a cellulose derivative coating to impart shelf stability of solid detergent compositions containing a catalyst activator. The solid, stabilized catalyst compositions are suitable for protecting catalysts in a variety of alkaline detergent compositions. In particular, the catalyst activator is coated by an encapsulate having at least one or a plurality of layers of the protective cellulose derivative(s) to prevent premature reaction of the catalyst during storage and/or transportation, thereby allowing the reactive component to be formulated into a shelf-stable detergent block composition. Methods of use are further provided.

BACKGROUND OF THE INVENTION

The use of active oxygen sources (e.g. peroxide) with a transition metal catalyst is known to improve bleaching performance; see for example U.S. Pat. No. 5,246,612. The improved efficacy for bleaching is beneficial for removing stains such as tea and/or coffee as well as starch soils on wares. However, the delivery of catalyst materials in detergent formulations, including highly alkaline compositions, suffers from numerous stability challenges. In many instances, formulation of the metal catalysts into solid alkaline detergents suffer from limited stability.

The use of coatings and/or encapsulation of particulate materials has been used for bleaching catalyst granules to increase stability; see for example, GB2428694, WO 03/093405 and WO 02/06659. Similarly, agglomerated forms have been disclosed in EP0072116 and EP0124341, and granules have been disclosed in EP544440, WO 1994021777, WO1995006710 and EP141470. The use of granular detergent products (e.g. formulations for consumer detergent use, see for example U.S. Pat. No. 5,703,034) has been used to incorporate bleach catalysts directly into a granular detergent product; however, stability concerns remain for formulating solid and/or multi-use detergent compositions containing catalysts. Therefore, when formulating solid block compositions there is a need for further stability and segregation of catalysts from the alkaline detergents.

In addition, prior compositions have stabilized catalysts using water soluble ligands or complexing agents, including for example EDTA, DTPA, NTA, and alkaline metal and alkaline earth metal salts, along with alkaline metal tryphosphates and the like, such as disclosed in EP10141470. Such compositions form water and soluble salts with the manganese to attempt to prevent release of magnesium dioxide. Further, use of biopolymers and polysaccharides, including starches is disclosed for use in stabilizing catalysts in U.S. Pat. No. 5,480,575. Sugars, such as mannitol are disclosed in EP2655588 for use with sulfonated polymers as coating materials for catalysts.

However, such methods do not overcome difficulties in use of catalysts, such as storage instability of the catalysts. Moreover, use of commercially-available catalyst materials (e.g. formulations containing metal and protective ligand) requires protection of the metal/ligand catalyst as opposed to prior art's use of water soluble ligands or complexing agents simply stabilizing the metal catalyst itself. A further disadvantage with encapsulates and granules is that they are generally bound to certain particle size constraints. An additional problem associated with such coatings and/or encapsulation is that the materials providing the protection may themselves have an adverse interaction with the component to be protected. Therefore, in some products stability has been increased by removing any easily oxidisable materials from the compositions. However, there remains a need to increase the shelf life of a highly alkaline solid detergent composition containing a catalyst.

The shelf life of a cleaning product may be regarded as the period of time over which the product may be stored while retaining its required performance efficacy. A satisfactory shelf life is in many instances a crucial factor for the success of a commercial product. A product with a short shelf life generally dictates that the product is made in small batches and is rapidly sold to the consumer. Beneficially, products with a longer shelf life may be made in larger batches, maintained in storage for a longer period of time and/or maintained by a consumer for a longer period of time before use. Accordingly, it is an objective of the claimed invention to develop detergents having increased shelf life and stability when employing catalysts.

It is an object of the present invention to mitigate the problems outlined above and/or to further improve the stability of particulate material comprising a bleach catalyst.

A further object of the invention is to provide methods of protection and/or coating a catalyst material in a solid detergent block with a cellulose derivative to protect the catalyst from the alkaline detergent.

Other objects, advantages and features of the present invention will become apparent from the following specification taken in conjunction with the accompanying drawings.

BRIEF SUMMARY OF THE INVENTION

An advantage of the invention is an improved shelf stability of solid alkaline detergent compositions containing a bleach catalyst. It is an unexpected benefit of the present invention that a catalyst is coated or encapsulated with a cellulose derivative (or a plurality of coatings thereof) to prevent premature reaction and/or degradation with the detergent formulation in a solid block detergent formulation. Beneficially, the storage and/or transportation stability of the compositions are significantly increased by the cellulose derivative encapsulation allowing formulation of the catalyst into solid detergent block compositions.

In an embodiment, the present invention provides solid stabilized catalyst detergent compositions. The compositions include: at least one alkalinity source and a stabilized catalyst comprising a cellulose derivative encapsulate coating and a catalyst. In an aspect, the catalyst has the following formula: $[(L_pMn_q)_nX_r]Y_s$, wherein each L independently is an organic ligand containing at least three nitrogen atoms and/or at least two carboxyl groups that coordinate with the Mn metal; wherein each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2^-$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and

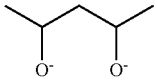

wherein R is a hydrogen or a $C_1$ to $C_6$ alkyl group; wherein p is an integer from 1 to 4; wherein q is an integer from 1 to 2; wherein r is an integer from 0 to 6; wherein Y is a counter ion; and wherein s is the number of counter ions. In some aspects, the cellulose derivative is hydroxypropyl methyl cellulose (HPMC). In some aspects, the alkalinity source is selected from the group consisting of alkali metal carbonates, alkali metal silicates, alkali metal metasilicates, alkali metal bicarbonates, alkali metal sesquicarbonates, alkali metal hydroxides, and combinations thereof.

In a still further embodiment, the present invention provides methods of cleaning and/or bleaching comprising: providing the solid stabilized catalyst detergent compositions; generating a use solution; and contacting a surface or object in need of cleaning and/or bleaching with the use solution of the detergent composition. In a further aspect, the use solution of the detergent composition is further contacted with an active oxygen source to provide enhanced bleaching.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The embodiments of this invention are not limited to particular detergent formulations employing the cellulose derivative coatings for the catalyst to enhance product stability, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism. For the purpose of this patent application, successful microbial reduction is achieved when the microbial populations are reduced by at least about 50%, or by significantly more than is achieved by a wash with water. Larger reductions in microbial population provide greater levels of protection.

Differentiation of antimicrobial "-cidal" or "-static" activity, the definitions which describe the degree of efficacy, and the official laboratory protocols for measuring this efficacy are considerations for understanding the relevance of antimicrobial agents and compositions. Antimicrobial compositions can affect two kinds of microbial cell damage. The first is a lethal, irreversible action resulting in complete microbial cell destruction or incapacitation. The second type of cell damage is reversible, such that if the organism is rendered free of the agent, it can again multiply. The former is termed microbiocidal and the later, microbistatic. A sanitizer and a disinfectant are, by definition, agents which provide antimicrobial or microbiocidal activity. In contrast, a preservative is generally described as an inhibitor or microbistatic composition As used herein, the term "sanitizer" refers to an agent that reduces the number of bacterial contaminants to safe levels as judged by public health requirements. In an embodiment, sanitizers for use in this invention will provide at least a 3 log reduction and more preferably a 5-log order reduction. These reductions can be evaluated using a procedure set out in *Germicidal and Detergent Sanitizing Action of Disinfectants*, Official Methods of Analysis of the Association of Official Analytical Chemists, paragraph 960.09 and applicable sections, 15th Edition, 1990 (EPA Guideline 91-2).

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Stabilized Catalyst Compositions

Exemplary ranges of the stabilized catalyst detergent compositions according to aspects of the invention are shown in Table 1 in weight percentage of the solid detergent compositions.

TABLE 1

| Material | First Exemplary Range wt-% | Second Exemplary Range wt-% | Third Exemplary Range wt-% | Fourth Exemplary Range wt-% |
|---|---|---|---|---|
| Alkaline Solidification Matrix (e.g. carbonate) | 10-80 | 20-70 | 30-60 | 30-50 |
| Stabilized Catalyst (e.g. coated/ encapsulated catalyst) | 0.01-15 | 0.1-10 | 1-10 | 1-5 |
| Surfactants | 1-60 | 5-50 | 10-50 | 15-45 |
| Additional Functional Ingredients | 0-45 | 0.1-30 | 1-30 | 1-25 |

In some aspects the ratio of the cellulose derivative coating to the catalyst material contained therein is in a ratio of from about 0.05:1 to about 1:1, preferably a ratio of the cellulose derivative coating to the active catalyst material is from 0.5:1 to about 1:1 In some aspects the stabilized catalyst (provided in the form of an encapsulated catalyst with at least one encapsulate layer of the cellulose derivatives) is included in the solid alkaline detergent in the amount from about 0.5 wt-% to about 2.5 wt-%, and more preferably from about 1 wt-% to about 2.5 wt-%. In addition, without being limited according to the invention, all ranges for the ratios recited are inclusive of the numbers defining the range and include each integer within the defined range of ratios.

The solid detergent compositions are preferably provided as concentrate compositions which may be diluted to form use compositions. In general, a concentrate refers to a composition that is intended to be diluted with water to provide a use solution that contacts an object to provide the desired cleaning, bleaching, or the like. The detergent composition that contacts the articles to be washed can be referred to as a concentrate or a use composition (or use solution) dependent upon the formulation employed in methods according to the invention. It should be understood that the concentration of the catalyst, cellulose derivative encapsulate for the catalyst, surfactants, alkalinity source(s) and other additional functional ingredients in the detergent composition will vary depending on solid concentrate provided and the desired use solution thereof.

In some aspects, the solid, stabilized catalyst detergent compositions maintain shelf stability for at least about 1 year at room temperature.

Cellulose Derivative Encapsulate

The stabilized catalyst detergent compositions according to the invention includes an encapsulate coating for the catalyst. Beneficially, the encapsulate coating surrounding the catalyst provides a method of protecting the catalyst from the alkaline detergent formulation according to an aspect of the invention, thereby eliminating stability problems associated with prior art systems. The encapsulate coating according to the invention provides at least one or a plurality of coatings (e.g. layers of the encapsulate coating) surrounding the catalyst.

In an aspect, the encapsulate coating provides at least one or a plurality of coatings having a thickness of from about 0.001-15 uM, from about 0.01-10 uM, or from about 0.1-10 uM. In an aspect, the encapsulate coating provides a coating to protect the bleach catalysts, allowing its incorporation into a solid detergent formulation without incurring any problems of stability and/or integrity. Without being limited to a particular mechanism of action or methods of making the solid stabilized detergent compositions, the coated catalysts having at least one or a plurality of coatings employing the cellulose derivatives are generally powdered encapsulated materials. Thereafter, the powder (comprising the encapsulated catalyst) is pressed into the solid detergent compositions.

Suitable encapsulate coatings include cellulose derivative polymers. Cellulose derivatives refer to organic compounds derived from the polysaccharide cellulose. Cellulose has the formula $(C_6H_{10}O_5)_n$ representing a linear chain of variable length glucose units. In an aspect, cellulose derivatives refer to organic compounds derived from the polysaccharide cellulose consisting of a linear chain of several hundred to tens of thousands beta(1→4) linked D-glucose units. An exemplary cellulose derivative suitable for the compositions according to the invention is hydroxypropyl methylcellulose (HPMC) which is a semisynthetic, viscoelastic polymer having the formula

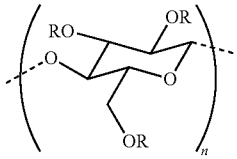

wherein R is H, $CH_3$ or $CH_2CH(OH)CH_3$. Additional examples of cellulosic materials suitable for the compositions according to the invention include carboxymethylcellulose (CMC), hydroxyethylcellulose (HEC), hydroxypropylcellulose (HPC), methylcellulose (MC), and cellulose triacetate.

In an aspect, the cellulose derivatives are water-soluble. By water-soluble, it is meant herein that the cellulose derivatives have solubility in water in the compositions according to the invention. In an aspect, water-soluble refers to polymers being soluble in water at about 25° C. at a concentration of at least about 1 wt-%, preferably at least about 5 wt-%, more preferably at least about 1-wt-% and most preferably at about 50-wt %. In aspects of the invention, the cellulose derivative has a concentration in a solid, stabilized catalyst detergent compositions from about 0.1 wt-% to about 10 wt-%, from about 0.5 wt-% to about 10 wt-%, from about 0.5 wt-% to about 5 wt-%, or from about 0.5 wt-% to about 2.5 wt-%. It is to be understood that all values and ranges between these values and ranges are encompassed by the invention.

Catalyst

The stabilized catalyst detergent compositions according to the invention include at least one catalyst. The term "catalyst," as used herein, refers to an agent, such as transition metals, used to activate a source of oxygen, such as hydrogen peroxide and/or percarbonate, providing improved bleaching activity and/or bubbling of a use solution to provide enhanced cleaning efficacy. In an aspect, catalysts are suitable for converting or decomposing active oxygen sources (i.e. oxidation) to generate catalytically enhanced bleaching species. In an aspect of the invention, the catalyst is readily degraded and therefore is in need of the coating using the cellulose derivative polymers according to the invention. For example, Mn (II) or Mn (III) are readily oxidated to form Mn (IV) species (turning to $MnO_2$), in particular when combined with oxidants and/or in an alkaline environment.

In an aspect of the invention, the catalyst agent is metallic. In a further aspect, the catalyst agent is can include various forms of metallic agents, including transition metals, including for example manganese.

In some aspects, the catalyst agent includes at least once source of manganese. In some embodiments, the manganese source is derived from manganese metal, manganese oxides, colloidal manganese, inorganic or organic complexes of manganese, including manganese sulfate, manganese carbonate, manganese acetate, manganese lactate, manganese nitrate, manganese gluconate, or manganese chloride, or any of the salts of salt forming species with manganese. Exemplary manganese-gluconate complexes are described in EP0237111; manganese-bi-pyridylamine complexes are described in EP0392593; and manganese-polyol complexes are described in EP0443651, as peroxygen bleach catalysts.

Commercially-available manganese catalysts are sold under the tradename Pegasus (Di[manganese(1+)], 1,2-bis (octahydro-4,7-dimethyl-1H-1,4,7-triazonine-1-yl-$kN^1$, $kN^4$, $kN^7$)-ethane-di-μ-oxo-μ-(ethanoato-kO, kO')-, di[chloride (1−)]), or Dragon (also known as Dragon's Blood or Dragon A350) (bis(octahydro-1,4,7-trimethyl-1H-1,4,7-triazonine-$kN^1$, $kN^4$, $kN^7$)-tri-μ-oxo-Di[manganese(1+)] sulfate tetrahydrate), available from Catexel Ltd.

In an aspect, the catalyst agent is a manganese-based complex that is a mononuclear or dinuclear complex of a Mn(III) or Mn(IV) transition metal. In a further aspect, the catalyst agent contains at least one organic ligand containing at least three nitrogen atoms that coordinate with the manganese. An exemplary structure is 1,4,7-triazacyclononane (TACN), 1,4,7-trimethyl-1,4,7-triazacyclononane (Me-TACN), 1,5,9-triazacyclododecane, 1,5,9-trimethyl-1,5,9-triazacyclododecane (Me-TACD), 2-methyl-1,4,7-triazacyclononane (Me/TACN), 2-methyl-1,4,7-trimethyl-1,4,7-triazacyclononane (Me/Me-TACN), N,N',N"-(2-hyroxyethyl)1,4,7-triazacyclononane. In a preferred embodiment, the ratio of the manganese atoms to the nitrogen atoms is 1:3.

Catalysts can also contain from 0 to 6 coordinating or bridging groups per manganese atom. When the manganese based catalyst is a mononuclear complex, coordinating groups are for example selected from —OMe, —O—$CH_2$—$CH_3$, or —O—$CH_2$—$CH_2$—$CH_3$. When the manganese based catalyst is a dinuclear complex, bridging groups may be selected, among others, from —O—, —O—O—, or —O—CH(Me)-O—. The catalyst can also contain one or more monovalent or multivalent counter ions leading to charge neutrality. The number of such monovalent or multivalent counter ions will depend on the charge of the manganese complex which can be 0 or positive. The type of the counter ions needed for the charge neutrality of the complex is not critical and the counter ions may be selected for example from halides such as chlorides, bromides and iodides, pseudohalides, sulphates, nitrates, methylsulfates, phosphates, acetates, perchlorates, hexafluorophosphates, or tetrafluoro-borates.

The catalysts suitable for use according to the invention may be defined according the following formula: $[(L_pMn_q)_n X_r]Y_s$, wherein each L independently is an organic ligand containing at least three nitrogen atoms and/or at least two carboxyl groups that coordinate with the Mn metal; each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2^-$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and

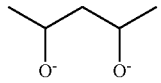

with R being hydrogen or a $C_1$ to $C_6$ alkyl group; p is an integer from 1 to 4; q is an integer from 1 to 2; r is an integer from 0 to 6; Y is a counter ion; and s is the number of counter ions.

The catalysts suitable for use according to the invention may also be defined according the following formula for a dinuclear manganese complex:

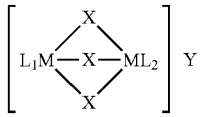

Wherein M is a Mn metal; $L_1$ and $L_2$ can either be separate ligands or where $L_1$ and $L_2$ can combine to be a single molecule. Among the coordinating or bridging groups, the groups $O^{2-}$, $O_2^{2-}$, $CH_3O$—, $CH_3CO^{2-}$,

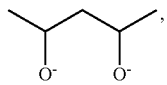

or Cl— are particularly preferred. In some aspects, the ligands are selected from the group consisting triazacyclononane, triazacyclononane derivatives, Schiff-base containing ligands, polypyridineamine ligands, pentadentate nitrogen-donor ligands, bispidon-type ligands, and macrocyclic tetraamidate ligands. Examples for those classes of ligands are described by R. Hage and A Lienke (Hage, Ronald; Lienke, Achim. Applications of Transition-Metal Catalysts to Textile and Wood-Pulp Bleaching. Angewandte Chemie International Edition, 2005, 45. Jg., Nr. 2, pp. 206-222), which is incorporated herein by reference in its entirety. Another group of preferred ligands are dicarboxylates, in particular oxalate.

Examples of catalyst structures that are particularly useful in the stabilized catalyst detergent compositions according to the invention include the following:

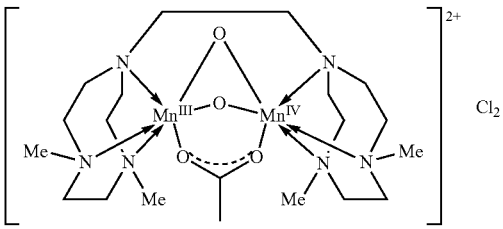

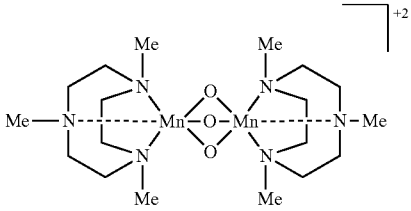

$(PF_6^-)_2$ or $(CH_3COO^-)_2$

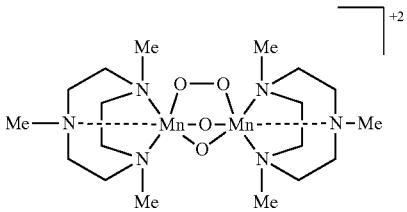

$(PF_6^-)_2$ or $(CH_3COO^-)_2$

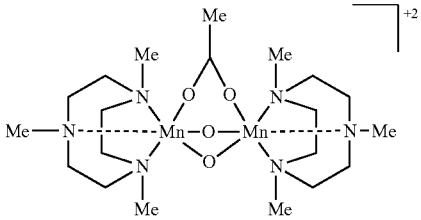

$(PF_6^-)_2$ or $(CH_3COO^-)_2$

Additional disclosure of metal complexes for catalysts is provided for example, in U.S. Pat. Nos. 5,227,084, 5,194,416, 4,728,455, 4,478,733, and 4,430,243, and European Patent Nos. 693,550, 549,271, 549,272, 544,519, 544,490, 544,440, 509,787, 458,397 and 458,398, each of which is herein incorporated by reference in its entirety.

In aspects of the invention, the catalyst has a concentration in solid, stabilized catalyst detergent compositions from about 0.01 wt-% to about 15 wt-%, from about 0.1 wt-% to about 10 wt-%, or from about 0.5 wt-% to about 5 wt-%. It is to be understood that all values and ranges between these values and ranges are encompassed by the invention.

As one skilled in the art will ascertain from the description herein of the stabilized catalyst detergent compositions, the amounts of catalysts employed in the solid compositions is a relatively small quantity, including down to the hundredths of a percent in a use solution for example, which are quantities much lower than bleach precursors which are often formulated into a detergent composition. Beneficially, the solid detergent formulations according to the invention providing the cellulose derivative encapsulated coating of the catalyst allow the formulation of the manganese-complex catalysts directly into the solid formulations and to be readily dissolved into a use solution of the stabilized catalyst detergent composition. As one skilled in the art will ascertain, the catalyst may be combined with inert materials, fillers and/or binders prior to encapsulation according to the invention. In an aspect, the catalyst is combined with an inert material such as cellulose prior to encapsulation with the cellulose derivative.

In an aspect, the encapsulated catalysts beneficially overcomes another limitation within the art which is the difficulty of accurately dosing the catalyst at the low dosages while also achieving a homogenous distribution of the catalyst throughout the detergent composition to provide sufficient efficacy within a use solution.

Alkalinity Sources

The solid stabilized catalyst detergent compositions of the present invention include at least one alkalinity source. In some aspects, the alkalinity source(s) function as a hydratable salt to form the solid compositions. In some aspects, the hydratable salt can be referred to as substantially anhydrous. As one skilled in the art will ascertain from the disclosure herein, there may also be included with the alkalinity source(s) in the solid detergent composition water of hydration to hydrate the alkalinity source(s). It should be understood that the reference to water includes both water of hydration and free water.

In some aspects, the alkalinity source(s) includes alkali metal carbonates. In some aspects, the alkalinity source(s) may include alkali metal hydroxides and/or alkali metal silicates. Examples of suitable alkalinity sources include but are not limited to: sodium hydroxide, potassium hydroxide, sodium carbonate, potassium carbonate, sodium silicate, potassium silicate, a mixture of alkali metal hydroxides, a mixture of alkali metal carbonates, a mixture of alkali metal silicates, and any mixtures of the same. In additional aspects, the alkalinity source(s) may include alkali metal metasilicates, bicarbonates, sesquicarbonates, and mixtures thereof.

The alkalinity source(s) largely control the pH of the resulting solution when water is added to the detergent composition to form a use solution. In some aspects, the alkalinity source(s) (e.g. sodium carbonate) provide a milder alkaline detergent, such as a pH greater than about 7; such as disclosed in U.S. Pat. No. 7,094,746, which is incorporated herein by reference in its entirety. In other aspects, the alkalinity source(s) provide a high alkaline detergent. In such aspects, The pH of the use solution is between approximately 10 and approximately 13 in order to provide sufficient detergency properties. In some aspects, the pH of the use solution is between about 10 and about 12. Beneficially, the stabilized catalyst detergent compositions can be formulated into alkaline and/or highly alkaline detergent compositions while still protecting the catalyst material.

In aspects of the invention the alkalinity sources are included in the solid stabilized catalyst detergent compositions, at a concentration of from about 10 wt-% to about 90 wt-%, from about 25 wt-% to about 90 wt-%, from about 30 wt-% to about 90 wt-%, from about 20 wt-% to about 70 wt-%, from about 40 wt-% to about 80 wt-%, from about 40 wt-% to about 75 wt-%, from about 30 wt-% to about 60 wt-%, or from about 30 wt-% to about 50 wt-%. It is to be understood that all values and ranges between these values and ranges are encompassed by the invention.

Surfactants

In some embodiments, the compositions of the present invention include a surfactant or surfactant system. A variety of surfactants can be used in a detergent compositions, including, but not limited to: anionic, nonionic, cationic, and zwitterionic surfactants. Exemplary surfactants that can be used are commercially available from a number of sources. For a discussion of surfactants, see for example, Kirk-Othmer, Encyclopedia of Chemical Technology, Third Edition, volume 8, pages 900-912, "Surface Active Agents and Detergents," Vol. I and II by Schwartz, Perry and Berch, each of which are herein incorporated by reference in its entirety.

Non-limiting examples of anionic surfactants useful in the detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Non-limiting examples of nonionic surfactants useful in the detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers.

Non-limiting examples of cationic surfactants that can be used in the detergent composition include, but are not limited to: amines such as primary, secondary and tertiary monoamines with C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl(C12-C18)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Non-limiting examples of zwitterionic surfactants that can be used in the detergent composition include, but are not limited to: betaines, imidazolines, and propionates.

In some aspects, where the detergent composition is intended to be used in an automatic dishwashing or ware washing machine, the surfactants selected, if any surfactant is used, can be those that provide an acceptable level of foaming when used inside a dishwashing or ware washing machine. It should be understood that ware washing compositions for use in automatic dishwashing or ware washing machines are generally considered to be low-foaming compositions.

When the detergent composition includes a surfactant as a cleaning agent, the cleaning agent is provided in an amount effective to provide a desired level of cleaning. In some embodiments, the compositions of the present invention include about 1 wt-% to about 60 wt-% of a surfactant. In other embodiments the compositions of the present invention include about 5 wt-% to about 50 wt-% of a surfactant. In still yet other embodiments, the compositions of the present invention include about 10 wt-% to about 50 wt-% of a surfactant, or from about 15 wt-% to about 45 wt-% of a surfactant.

Additional Functional Ingredients

The components of the detergent composition can further be combined with various functional components. In some embodiments, the solid, stabilized catalyst detergent composition including the cellulose derivative, catalyst, alkalinity source and surfactants make up a large amount, or even substantially all of the total weight of the detergent composition. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash and/or laundry applications. However, other embodiments may include functional ingredients for use in other applications.

In some embodiments, the compositions may include solvents, activating agents, defoaming agents, enzymes, anti-redeposition agents, additional bleaching agents, solubility modifiers, dispersants, rinse aids, metal protecting agents, stabilizing agents, corrosion inhibitors, surface modification polymers, such as soil release polymers, starches, fluid repellants, whitening additives, such as optical brighteners or hueing agents, additional sequestrants and/or chelating agents, fragrances and/or dyes, rheology modifiers or thickeners, hydrotropes or couplers, buffers, solvents and the like.

Activating Agents

In some embodiments, the compositions include an activating agent to further increase the activity of the active oxygen source (e.g. percarbonate) which may be combined with the compositions according to the invention (e.g. combined with a use solution of the detergent composition). Such an activating agent can be used in addition to the catalyst. Suitable activating agents include sodium-4-benzoyloxy benzene sulphonate (SBOBS); N,N,N',N'-tetraacetyl ethylene diamine (TAED); sodium-1-methyl-2-benzoyloxy benzene-4-sulphonate; sodium-4-methyl-3-benzoyloxy benzoate; SPCC trimethyl ammonium toluyloxy benzene sulphonate; sodium nonanoyloxybenzene sulphonate, sodium 3,5,5,-trimethyl hexanoyloxybenzene sulphonate; penta acetyl glucose (PAG); octanoyl tetra acetyl glucose and benzoyl tetracetyl glucose.

Chelants

In some embodiments, the compositions include a chelant/sequestering agent. Suitable chelating/sequestering agents are, for example, citrate, aminocarboxylic acid, condensed phosphate, phosphonate, and polyacrylate. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder. The chelating/sequestering agent may also function as a threshold agent when included in an effective amount. The concentrated detergent composition can include 0.1 to 70% by weight, preferably 5 to 60% by weight, more preferably 5 to 50% by weight, most preferably 10 to 40% by weight of a chelating/sequestering agent.

Suitable aminocarboxylic acids include, for example, methylglycinediacetic acid (MGDA), N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration. The composition may include a phosphonate such as 1-hydroxyethane-1,1-diphosphonic acid $CH_3C(OH)[PO(OH)_2]_2$ (HEDP); amino tri(methylenephosphonic acid) $N[CH_2PO(OH)_2]_3$; aminotri(methylenephosphonate), sodium salt $(NaO)(HO)P(OCH_2N[CH_2PO(ONa)_2]_2)$; 2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[CH_2)_6N[CH_2PO(OH)_2]_2]_2$; and phosphorus acid $H_3PO_3$.

The chelating/sequestering agent may also be a water conditioning polymer that can be used as a form of builder. Exemplary water conditioning polymers include polycarboxylates. Exemplary polycarboxylates that can be used as water conditioning polymers include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. The concentrated detergent composition may include the water conditioning polymer in an amount of 0 to 20% by weight, preferably 0.1 to 5% by weight.

Defoaming Agents

In some embodiments, the compositions include a defoaming agent, which may be in addition to low or no-foaming surfactants. In some aspects, suitable defoaming agents include, for example, ethylene oxide/propylene block copolymers such as those available under the name Pluronic N-3, silicone compounds such as silica dispersed in polydimethylsiloxane, polydimethylsiloxane, and functionalized polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate.

Active Oxygen Source

The stabilized catalyst detergent compositions according to the invention can be combined with at least one active oxygen compound. In an preferred aspect, the stabilized catalyst detergent compositions are combined at a point of use or in a use solution with an active oxygen compound to provide enhanced bleaching when combined with the catalyst. The active oxygen sources suitable for use according to the invention can be inorganic or organic, and can be a mixture thereof.

Some examples of active oxygen compound include peroxygen compounds, peroxygen compound adducts, hydrogen peroxide, hydrogen peroxide liberating or generating compounds, and inorganic and organic peroxyacids. Many active oxygen compounds are peroxygen compounds, including for example hydrogen peroxide, group 1 (IA) active oxygen compounds (e.g., sodium peroxide), group 2 (IIA) active oxygen compounds (e.g., magnesium peroxide), group 12 (IIB) active oxygen compounds (e.g., zinc peroxide), group 13 (IIIA) active oxygen compounds (e.g., perborates), group 14 (IVA) active oxygen compounds (e.g., persilicates and peroxycarbonates), group 15 (VA) active oxygen compounds (e.g., perphosphates), group 16 (VIA) active oxygen compounds (e.g., peroxysulfuric acids and their salts), group 17 (VITA) active oxygen compounds (e.g., sodium periodate), and transition metal peroxides. Any of a variety of hydrogen peroxide and/or hydrogen peroxide adducts are suitable for use in the present invention.

Sodium percarbonate ($2Na_2CO_3.3H_2O_2$) can also be employed as the active oxygen compound for the stabilized catalyst detergent compositions. Percarbonate is an alternative to solid peroxide for use in solid detergent formulations. Sodium percarbonate is commercially-available in the form of coated granulates to provide enhanced stability.

Active oxygen compounds, including organic active oxygen compounds may also include peroxycarboxylic acids, such as a mono- or di-peroxycarboxylic acid, an alkali metal salt including these types of compounds, or an adduct of such a compound.

Peracid, peroxyacid, percarboxylic acid and peroxycarboxylic acid each refer synonymously to acids having the general formula $R(CO_3H)_n$. The R group can be saturated or unsaturated as well as substituted or unsubstituted. As described herein, R is an alkyl, arylalkyl, cycloalkyl, aromatic, heterocyclic, or ester group, such as an alkyl ester group. N is one, two, or three, and named by prefixing the parent acid with peroxy. Ester groups are defined as R groups including organic moieties (such as those listed above for R) and ester moieties. Exemplary ester groups include aliphatic ester groups, such as $R_1OC(O)_2$, where each of $R_1$ and $R_2$ can be aliphatic, preferably alkyl, groups described above for R. Preferably $R_1$ and $R_2$ are each independently small alkyl groups, such as alkyl groups with 1 to 5 carbon atoms. As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups). Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups. In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

Sulfoperoxycarboxylic acid, sulfonated peracid, or sulfonated peroxycarboxylic acid each refer synonymously to the peroxycarboxylic acid form of a sulfonated carboxylic acid. Additional description of suitable peracids for use according to the invention is set forth, for example, in U.S. Patent Publication Nos. 2013/0047345 and 2013/0018099.

Methods of Use

In some aspects, the stabilized catalyst detergent compositions are suitable for use in various applications that requires protection of a catalyst material from other components in a formula (e.g. alkalinity). Without being limited according to the applications of use of the invention, the stabilized catalyst compositions are particularly suitable for the protection of oxidation catalysts in bleaching systems, such as for laundry and ware washing. In particular, the bleaching systems may include ware wash detergents, coffee and/or tea destainers, clean-in-place (CIP) applications employing peroxygen activation catalysts for peroxide or peracid cleaners, surgical instrument cleaning and the like, laundry applications, and the like. In aspects, the bleach product (e.g. inactivated sodium percarbonate) is combined with the detergent compositions according to the invention.

In a further aspect however, the stabilized catalyst compositions are suitable for protection of oxidation catalysts in wastewater treatment, epoxidation reactions, and many other applications. In such applications there is a need for the removal of microbes (e.g. wastewater treatment) from wastewater which is often rich in malodorous compounds of reduced sulfur, nitrogen, phosphorous and the like. In such aspects, detergent compositions containing a strong oxidant are employed to convert these compounds efficiently to their odor free derivatives e.g. the sulfates, phosphates and amine oxides. These same properties are very useful in the treatment of other water sources, including industrial applications (e.g. treatment of slick water and other applications customary in oil and/or gas drilling) where the property of bleaching is also of great utility.

In still further aspects, the stabilized catalyst compositions are suitable for protection of oxidation catalysts in pulp and paper bleaching. As referred to herein, pulp and paper bleaching may be employed in the "papermaking process," referring to methods of making paper products from pulp generally comprising forming an aqueous cellulosic papermaking furnish, draining the furnish to form a sheet and drying, the sheet. The steps of forming the papermaking furnish, draining, and drying may be carried out in any conventional manner generally known to those skilled in the art. The pulp may be any either or both of virgin pulp and recycled pulp.

In some aspects, the stabilized catalyst detergent compositions are preferably for use in an automatic washing detergent formulation e.g. such as a dishwasher detergent or a laundry detergent.

In some aspects, the detergent compositions are contacted by a diluent, such as water to generate a concentrate and/or use solution for the various applications of use. The detergent compositions can include concentrate compositions or can be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as the use composition. The use solution can include additional functional ingredients at a level suitable for cleaning, bleaching, or the like.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In one embodiment, the concentrate is diluted at a ratio of between about 1:10 and about 1:1000 concentrate to water. Particularly, the concentrate is diluted at a ratio of between about 1:100 and about 1:5000 concentrate to water.

In some aspects, the concentrate compositions according to the invention are provided in the dilution range of about 0.01 g/L to about 10 g/L, from about 0.1 g/L to 10 g/L, from about 0.4 g/L to 5.5 g/L, or from about 0.5 g/L to 5 g/L, which will depend upon the dosing required for a particular application of use (e.g. ware wash detergent, laundry detergent, or the like).

In some aspects, the use solutions according to the invention provide a desired level of catalyst from about 0.01 ppm to about 5 ppm, from about 0.02 ppm to about 5 ppm, from about 0.05 ppm to about 2 ppm.

In some aspects, the use solution is combined with a source of active oxygen for activation and/or enhanced bleaching according to various methods of use thereof. In an aspect, the active oxygen source is added concurrently (e.g. during a wash step) with the detergent composition use solution. Beneficially, the stabilized catalyst is available to provide activation of the bleach source and therefore increase overall stain removal.

In some aspects, the present invention provides methods for removing soils from a surface, e.g., a hard surface, and/or bleaching a surface. In some embodiments, the method comprises applying a use solution of the detergent composition (e.g. contacting) to the surface, and removing the composition from the surface after an amount of time sufficient to facilitate soil removal and/or bleaching. The contacting step can last for any suitable time. In some embodiments, the contacting step lasts for at least 10 seconds, 20 seconds, 30 seconds, 40 seconds, 50 seconds, 1 minute, 10 minutes, 30 minutes, 1 hour, 2 hours, 4 hours, 8 hours, 16 hours, 1 day, 3 days, 1 week, or longer. The detergent composition can be applied to the surface (or target for soil removal and/or bleaching) in any suitable manner. In some embodiments, the detergent composition is applied by means of a spray, a foam, or the like.

The methods can be used to achieve any suitable removal of soil (e.g. cleaning), sanitizing, disinfecting, bleaching and/or reduction of the microbial population in and/or on the surface or target. In some embodiments, the methods can be used to reduce the microbial population by at least one log 10. In other embodiments, the present methods can be used to reduce the microbial population in and/or on the target or the treated target composition by at least two log 10. In still other embodiments, the present methods can be used to reduce the microbial population in and/or on the target or the treated target composition by at least three log 10.

In some embodiments, the method further comprises rinsing the surface. In some embodiments, the method further comprises generating a bubbling effect of the detergent compositions containing the active oxygen source and catalyst (and/or an active oxygen source combined with the detergent composition containing the catalyst). In some embodiments, the method further comprises a mechanical application of force, agitation and/or pressure to assist in removing the soils and/or bleaching the surface.

The methods of the present invention can be used to remove a variety of soils from a variety of surfaces and/or bleaching a variety of surfaces. For example, surfaces suitable for cleaning using the methods of the present invention include, but are not limited to, walls, floors, ware, dishes, flatware, pots and pans, heat exchange coils, ovens, fryers, smoke houses, sewer drain lines, and the like.

In some embodiments, the methods of the present invention are followed by only a rinse step. In other embodiments, the methods of the present invention are followed by a conventional CIP method suitable for the surface to be cleaned. In still yet other embodiments, the methods of the present invention are followed by a CIP method such as those described in U.S. Pat. Nos. 8,398,781 and 8,114,222 entitled "Methods for Cleaning Industrial Equipment with Pre-treatment," both of which are hereby incorporated by reference in their entirety.

Beneficially, according to the various aspects, the methods protect catalysts formulated within an alkaline solid stabilized catalyst detergent compositions prior to a point of use.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Various formulations of standalone catalyst performance were assessed after encapsulation without formulating into a solid detergent composition. A commercially-available manganese catalyst-Di[manganese(1+)], 1,2-bis(octahydro-4,7-dimethyl-1H-1,4,7-triazonine-1-yl-kN$^1$, kN$^4$, kN$^7$)-ethane-di-μ-oxo-μ-(ethanoato-kO, kO')-, di[chloride (1−)] was employed in the examples.

Initially, the catalyst was coated by cellulose acetate phthalate (CAP) polymer and evaluated. Catalyst solutions were prepared by dissolving 1.96 g of the manganese catalyst-CAP encapsulate (2.5% active catalyst) into 100 g of deionized water. Of that aqueous solution, 0.5 g was dosed into 1 L of water, to deliver an active catalyst concentration of 0.25 ppm.

For the uncoated manganese catalyst control, 0.049 g was dissolved into 100 g of deionized water. Of that aqueous solution, 0.5 g was dosed into 1 L of water, to deliver an active catalyst concentration of 0.25 ppm.

Wash testing was completed in the tergotometer at 122° F. One liter of 5 grain water was added to each pot, and each experiment was performed in triplicate. Each pot contained two each of tea on cotton and coffee on poly/cotton fabric swatches. At the start of a 12 minute wash run 0.5 g of a commercially available low-alkaline liquid detergent (Detergent 120), 1.0 g of 35% hydrogen peroxide, 1.2 g of a commercially available NaOH based alkaline builder (Builder C) and 0.5 g of the aqueous catalyst solutions described above were added to each pot. At the end of 12 minutes, the swatches were removed from each pot, rinsed under cold water and air dried overnight.

To determine the percent (%) stain removal (SR) the reflectance of the fabric sample was measured on a spectrophotometer (ColorQuest XE, Hunter Associates Laboratory). The "L value" is a direct reading supplied by the spectrophotometer. L generally is indicative of broad visible spectrum reflectance, where a value of 100% would be absolute white. The % soil removal was calculated using the following formula:

$$SR=((L_{final}-L_{initial})/(96L_{initial}))*100\%$$

TABLE 2

| | Tea (cotton) | Coffee (poly/cotton) |
|---|---|---|
| Uncoated | 63.92 | 71.87 |
| CAP coated | 39.86 | 44.64 |

Table 2 shows stain removal performance of the catalyst after encapsulation (prior to formulation into a solid detergent) with the cellulose derivative polymer cellulose acetate phthalate (CAP). As can be seen in Table 2, the cellulose derivative cellulose acetate phthalate (CAP) polymer had an immediately detrimental effect on catalyst performance, therefore demonstrating this polymer would not be a suitable choice for further studies testing stability when formulated into the detergent.

Example 2

Additional encapsulates, including an additional cellulose derivative, were evaluated. The manganese catalyst of Example 1 was coated with polyvinyl alcohol (PVA) and compared to the same manganese catalyst encapsulated with hydroxypropyl methylcellulose (HPMC). Encapsulated catalyst solutions were prepared by dissolving 1.2 g of the manganese catalyst encapsulate (2.5% active catalyst) into 100 g of deionized water. Of that aqueous solution, 0.66 g was dosed into 1 L of water, to deliver an active catalyst concentration of 0.2 ppm.

For the uncoated manganese catalyst control, 0.03 g was dissolved into 100 g of deionized water. Of that aqueous solution, 0.66 g was dosed into 1 L of water, to deliver an active catalyst concentration of 0.2 ppm.

Wash testing was completed in the tergotometer at 104° F. One liter of 5 grain water was added to each pot, and each experiment was performed in triplicate. Each pot contained two each of tea on cotton and coffee on poly/cotton fabric swatches. At the start of a 10 minute wash run 0.66 g of the solid alkaline detergent, 1.0 g of 35% hydrogen peroxide and 1.3 g of a commercially available NaOH based alkaline builder (Builder C) were added to each pot. At the end of 10 minutes, the swatches were removed from each pot, rinsed under cold water and air dried overnight. To determine the percent (%) stain removal (SR) the reflectance of the fabric sample was measured according to the methods of Example 1.

TABLE 3

| | Tea (cotton) | Coffee (poly/cotton) |
|---|---|---|
| Uncoated | 39.99 | 56.56 |
| PVA coated | 20.52 | 35.15 |
| HPMC coated | 37.70 | 56.76 |

Table 3 shows the stain removal performance to assess catalyst stability after encapsulation, prior to formulation into a detergent. As shown in Table 3, the process of encapsulating the manganese catalyst with the polyvinyl alcohol (PVA) polymer had an immediately detrimental effect on catalyst performance, in comparison to the use of a cellulose derivative. By contrast, manganese catalyst encapsulated with HPMC stayed fully stable after the encapsulation process.

Example 3

The stable catalyst coated with the HPMC encapsulate according to Example 2 was formulated into a solid detergent block composition for further evaluation of stability and efficacy in comparison to uncoated compositions. The formulation is shown in Table 4.

TABLE 4

| | | | |
|---|---|---|---|
| Carbonate Alkalinity Source | 42.40 | 42.40 | 42.40 |
| Manganese Catalyst, 50% (e.g. uncoated catalyst) | | 0.06 | |
| Manganese Catalyst 50%, HPMC coated | | | 1.2 |
| Surfactants | 38 | 38 | 38 |
| Stabilizer | 6.00 | 6.00 | 6.00 |
| Additional Functional Ingredients | 13.58 | 13.58 | 13.58 |
| TOTAL | 100 | 100 | 100 |

After formulation, samples were stored in a 122° F. oven. Aliquots were taken initially and after 4 weeks storage, and the performance compared over time as shown in Table 5.

TABLE 5

| | Tea (cotton) | | Coffee (poly/cotton) | |
|---|---|---|---|---|
| | Day | | | |
| | 0 | 28 | 0 | 28 |
| H2O2 alone (no catalyst) | 21.83 | 25.89 | 32.41 | 25.77 |
| Manganese Catalyst - Uncoated | 53.75 | 27.45 | 63.63 | 24.99 |
| Manganese Catalyst - HPMC coated | 51.67 | 56.87 | 63.55 | 68.54 |

Immediately after formulation (day 0), both the uncoated and HPMC coated manganese catalyst show a significant performance increase over hydrogen peroxide alone. However, after four weeks of long term storage at 122° F., with the uncoated manganese catalyst the performance improvement was completely eliminated, i.e. there was no difference with the catalyst containing detergent compared to hydrogen peroxide alone. By contrast, the manganese catalyst coated with HPMC was fully stable, with no change in performance from day 0 to day 28. For the testing shown in Table 5 hydrogen peroxide was added directly to the sample at a use solution.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. A solid stabilized catalyst detergent composition comprising:

from about 40-60 wt-% of at least one alkali metal carbonate alkalinity source;

a stabilized catalyst, wherein the catalyst comprises $C_{20}H_{43}Mn_2N_6O_4Y_s$, wherein Y is a counter ion and s is the number of counter ions; wherein the stabilized catalyst is encapsulated by a polymer, wherein the polymer comprises hydroxypropyl methylcellulose (HPMC)

wherein said solid stabilized catalyst detergent composition is formulated into a solid block composition, and wherein the composition has a use pH of at least about 8.5.

2. The detergent composition according to claim 1, further comprising an additional alkalinity source, wherein said additional alkalinity source is an alkali metal silicate, alkali metal metasilicate, alkali metal bicarbonate, alkali metal sesquicarbonate, and/or alkali metal hydroxide.

3. The detergent composition according to claim 2, wherein the composition has a use pH of between approximately 10 and approximately 13.

4. The detergent composition according to claim 1, wherein the stabilized catalyst comprises an inner portion consisting of the catalyst and at least one outer portion comprising the cellulose derivative.

5. The detergent composition according to claim 4, wherein the inner portion consists of between 0.5 wt-% and 10 wt-% of the catalyst.

6. The detergent composition according to claim 4, wherein the outer portion comprises a plurality of layers of the cellulose derivative encapsulate.

7. The detergent composition according to claim 1, comprising from about 40-50 wt-% of the alkalinity source, from about 0.5-10 wt-% of the stabilized catalyst, from about 0-45 wt-% of at least one surfactant, and from about 0-30 wt-% of at least one additional functional ingredient.

8. A solid stabilized catalyst detergent composition comprising:

from about 40-60 wt-% of an alkali metal carbonate alkalinity source;

from about 1-60 wt-% of at least one surfactant;

from about 0.1-30 wt-% of at least one additional functional ingredient; and from about 0.5-10 wt-% a stabilized catalyst, wherein the stabilized catalyst is encapsulated by a polymer and comprises $C_{20}H_{43}Mn_2N_6O_4Y_s$; wherein Y is a counter ion; wherein s is the number of counter ions, wherein the polymer comprises hydroxypropyl methylcellulose (HPMC); and wherein said solid stabilized catalyst detergent composition is formulated into a solid block composition, and wherein the composition has a use pH of at least about 8.5.

9. The detergent composition according to claim 8, wherein the composition has a use pH of between approximately 10 and approximately 13.

10. The detergent composition according to claim 8, wherein the stabilized catalyst comprises an inner portion consisting of between 0.5 wt-% and 10 wt-% of the catalyst, and an outer portion comprising a plurality of layers of the cellulose derivative encapsulate.

11. A method of cleaning and/or bleaching comprising: providing the solid stabilized catalyst detergent composition of claim 1; generating a use solution of the detergent composition; and contacting a surface or object in need of cleaning and/or bleaching with the use solution of the detergent composition.

12. The method according to claim 11, further comprising the addition of an active oxygen source to the use solution of the detergent composition to provide bleaching benefits with the stabilized catalyst.

13. The method according to claim 11, wherein the use solution of the detergent composition is employed in a ware washing and/or laundry application, and wherein the solid stabilized catalyst detergent composition maintains stability of the catalyst while formulated into the alkaline detergent composition.

14. The method according to claim 11, wherein the use solution of the detergent composition is employed in a pulp and/or paper bleaching, wastewater treatment and/or epoxidation reaction application, and wherein the solid stabilized catalyst detergent composition maintains stability of the catalyst while formulated into the alkaline detergent composition.

* * * * *